US011000085B2

(12) United States Patent
Rodriguez

(10) Patent No.: US 11,000,085 B2
(45) Date of Patent: May 11, 2021

(54) GLOVE PALM COVER

(71) Applicant: Brian J. Rodriguez, Wichita, KS (US)

(72) Inventor: Brian J. Rodriguez, Wichita, KS (US)

( * ) Notice: Subject to any disclaimer, the term of this patent is extended or adjusted under 35 U.S.C. 154(b) by 87 days.

(21) Appl. No.: 15/983,420

(22) Filed: May 18, 2018

(65) Prior Publication Data

US 2018/0263320 A1 Sep. 20, 2018

(51) Int. Cl.
*A41D 27/12* (2006.01)
*A41D 19/00* (2006.01)
*A41F 1/06* (2006.01)

(52) U.S. Cl.
CPC ..... *A41D 27/12* (2013.01); *A41D 19/0037* (2013.01); *A41D 19/0048* (2013.01); *A41D 2300/32* (2013.01); *A41D 2600/10* (2013.01); *A41F 1/06* (2013.01)

(58) Field of Classification Search
CPC ..... A41D 27/12; A41D 19/0037; A41D 19/0048; A41D 2300/32; A41D 2600/10; A41D 13/081; A41D 13/082; A41D 19/0024; A41D 19/0034; A41D 19/0041; A41D 19/0044; A41D 19/01547; A41D 19/01552; A41F 1/06; A63B 71/14; A63B 71/141; A63B 71/146
USPC .... 2/160, 161.1, 161.2, 161.3, 161.4, 161.8, 2/910, 917
See application file for complete search history.

(56) References Cited

U.S. PATENT DOCUMENTS 1,836,223 A * 12/1931 Burns ..... B65G 7/12 294/25
4,707,861 A * 11/1987 Lavoie ..... A41D 13/08 2/16
4,787,376 A 11/1988 Eisenberg
5,022,094 A * 6/1991 Hames ..... A41D 19/01547 2/159
5,033,119 A 7/1991 Wiggins
5,081,715 A 1/1992 Mascia
5,136,759 A * 8/1992 Armour, II ..... A44B 18/00 24/16 R
5,195,188 A 3/1993 Bourdeau et al.
5,197,149 A 3/1993 Overton
(Continued)

FOREIGN PATENT DOCUMENTS

| | | |
|---|---|---|
| GB | 2456609 | 7/2009 |
| JP | 2011106040 | 6/2011 |
| WO | WO2010071115 | 12/2009 |

OTHER PUBLICATIONS

Google search "hem define" (Year: 2020).*

*Primary Examiner* — Sally Haden

(74) *Attorney, Agent, or Firm* — Kenneth H. Jack; Davis & Jack, L.L.C.

(57) ABSTRACT

A cover for a glove having a back, a wrist, a thumb, index fingers, a web, a sizing strap, and a hook and loop fastener, the cover incorporating a sheet having a flexible base and a loop attached to the base; a web arm attached to the flexible sheet and extending oppositely from the base; a wrist arm attached to the flexible sheet and extending oppositely from the base; a first hook and loop fastener attached to the web arm and adapted for, upon attaching the loop to the sizing strap, wrapping around the glove and engaging the glove's hook and loop fastener; and a second hook and loop fastener attached to the wrist arm and adapted for wrapping around the glove's wrist and engaging the glove's hook and loop fastener.

6 Claims, 6 Drawing Sheets

(56) References Cited

U.S. PATENT DOCUMENTS

| | | | | |
|---|---|---|---|---|
| 5,350,418 | A * | 9/1994 | Janevski | A61F 5/0118 602/21 |
| 5,517,694 | A | 5/1996 | Fabry | |
| 5,608,912 | A | 3/1997 | Cumberland | |
| 5,740,555 | A | 4/1998 | Renegar | |
| 5,809,569 | A * | 9/1998 | Bruno | A41D 19/0034 2/158 |
| 5,887,282 | A * | 3/1999 | Lenhart | A41D 19/0037 2/159 |
| 5,890,228 | A | 4/1999 | Wagner | |
| 6,102,880 | A * | 8/2000 | Nelson | A61F 5/0118 602/20 |
| 6,223,354 | B1 | 5/2001 | Carothers | |
| 6,415,445 | B1 | 7/2002 | Nishijima et al. | |
| 6,757,915 | B2 | 7/2004 | Sidlo | |
| 7,062,791 | B2 | 6/2006 | Gold | |
| 7,305,718 | B2 * | 12/2007 | Avallone | A41D 19/01582 2/11 |
| RE42,895 | E | 11/2011 | Thiruppathi | |
| 8,771,820 | B1 | 7/2014 | Goodspeed | |
| 8,966,666 | B2 | 3/2015 | Faulconer | |
| 9,017,182 | B1 * | 4/2015 | Freiler, Jr. | A63B 69/3608 473/205 |
| 10,143,579 | B2 * | 12/2018 | Mueller | A61F 5/0118 |
| 2009/0070849 | A1 | 12/2009 | Iwasako | |
| 2012/0096614 | A1 | 4/2012 | Sebasco | |
| 2014/0250630 | A1 * | 9/2014 | Nugent | B25G 1/02 16/110.1 |
| 2018/0055108 | A1 | 3/2018 | Long et al. | |

* cited by examiner

GLOVE PALM COVER

FIELD OF THE INVENTION

This invention relates to sports and athletic gloves of the type which include an adjustable wrist sizing strap. More particularly, this invention relates to apparatus and assemblies which are adapted for attachment to such gloves for the protection of such gloves' palm covering portions, and for modifying the frictional characteristics of such gloves' palm covering portions.

BACKGROUND OF THE INVENTION

Common athletic gloves such as golf gloves tend to become prematurely worn, abraded, and torn at their palm covering areas. During golf club holding use and during a golf swing, the typically leather palm portion of a golfer's golf glove intensely frictionally contacts the golf club's handle. Such frictional contact undesirably causes thinning, wearing, and in extreme cases, tearing of the palm covering portion of the glove. Also, such frictional contact may undesirably interfere with proper handle motion within a golfer's non-dominant hand while executing a golf swing.

When a golf glove becomes torn through golf club swinging use, the glove is typically deemed unuseable and non-functional, and must be discarded and replaced. Golf gloves are typically expensive items of golfing equipment, and discarding and replacing such gloves due to usage and wear is undesirable.

The instant inventive glove cover solves or ameliorates the problems and deficiencies of common athletic gloves, golf gloves in particular, by providing a specially configured multiply armed flexible sheet which includes specialized fastening components for engagement with the golf glove and for covering of the palm portion of the glove during use. Such covering reverses wear of the underlying glove, and where the covering comprises a relatively low friction material such as vinyl, the covering advantageously lowers friction between a club handle and the golfer's hand.

BRIEF SUMMARY OF THE INVENTION

The instant inventive cover for a glove is intended for use upon and for the protection of a sports glove, typically a golfing glove. Such gloves conventionally have a hand back covering portion, a wrist portion, thumb and forwardly extending finger portions, and have webs between the fingers and thumb including a first web spanning between the bases of the glove's thumb and index fingers. A glove upon which the instant invention is preferably utilized is preferably of the type which includes an adjustable wrist sizing strap, and which incorporates a "VELCRO"-type hook and loop fastener for securing the sizing strap at a selected glove anchoring annular tension about the wearer's wrist.

A first structural component of the instant inventive cover for a glove comprises a durable flexible sheet which is suitably composed of vinyl, leather, or woven fabric. The flexible sheet preferably has a central glove palm covering portion or area, and has a base end which is longitudinally sized or has a front to rear dimension closely matching the front to rear dimension of the base end of the glove's wrist sizing strap.

A further structural component of the instant inventive cover for a glove comprises a loop which is fixedly attached to the base end of the flexible sheet. In a preferred embodiment, the loop component is sized for receiving and engaging the glove's sizing strap. In the preferred embodiment, the loop is composed of elastic cording. The fixed attachment of the loop to the base end of the flexible sheet is preferably achieved by means of a loop capturing hem sewn into the sheet's base end.

A further structural component of the instant inventive cover for a glove comprises a web arm which is preferably composed of the same material as the flexible sheet's material. In a preferred embodiment, the invention's web arm component is positioned forwardly with respect to the flexible sheet's central palm covering portion, such arm being fixedly attached to or formed wholly with the flexible sheet. In the preferred embodiment, the web arm extends oppositely from the flexible sheet's base end.

A further structural component of the instant inventive cover for a glove comprises a second arm or wrist encircling arm which is positioned rearwardly from the web arm. The wrist arm is preferably composed of the same material as the web arm, and such arm is similarly attached to the flexible sheet to extend oppositely from the flexible sheet's base end. In a preferred embodiment, the wrist arm component is canted or angled rearwardly with respect to the web arm's extension.

Further structural components of the instant inventive cover for a glove comprise a pair of pads of the type incorporated in hook and loop fasteners. Each of such pads preferably comprises a hook pad or a loop pad. The invention's pair of pads are preferably fixedly attached to distal ends of the web and wrist arm components. Complimenting pair of pads are preferably additionally provided, such pads being y secured to opposite sides of the distal ends of the web and wrist arms.

In use of the instant inventive cover for a glove, a right handed golfer may don a left hand golf glove of the type described above having an adjustable hook and loop fastener fastenable wrist sizing strap. With such sizing strap disconnected and splayed counter-clockwise away from its attached position, the golfer may initially thread the distal end of the wrist sizing strap through the cover's loop component.

Thereafter, and prior to fastening of the wrist sizing strap, the golfer may extend the cover's wrist arm about the wrist portion of the glove, and may extend the cover's web arm over and about the glove's first web, such web arm extension passing the web arm between the glove's thumb and index finger. Assuming, for example, that a flexible loop pad is sewn to the back of the glove, hook pads residing at the distal ends of the web and wrist arms may be directly engaged with the glove's loop pad. Where the complimentary pair of pads are provided, as is preferred, such pads preferably comprise loop pads so that, upon engagement of the glove's sizing strap in a normal fastening attachment to the glove back positioned loop pad, the glove's hook pad may simultaneously engage the web and wrist arms' corresponding loop pads.

The above described glove encircling extensions of the web and wrist arms advantageously position the central and palm covering portion of the glove cover over the palm portion of the golf glove. During such palm covering positioning, three point anchoring of the cover provided at the cover's base end by the loop, and provided by the interstitial attachments of the pads at the ends of the web and wrist arms securely hold the glove cover's palm portion over the glove's palm.

Utilization of the instant inventive glove cover upon a glove having a worn or torn palm advantageously restores the glove for further use. Alternative utilization of the instant inventive cover upon a relatively new and unworn glove advantageously extends the use life of the glove.

Additionally, where the material selected for the cover comprises relatively low friction vinyl, the invention advantageously lowers friction between a golfer's hand and the club handle promoting correct handle motion of the club during a golf swing.

Accordingly, objects of the instant invention include the provision of a cover for a glove which incorporates structures as described above, and which arranges those structures in relation to each other in manners described above, for the achievement of the functional benefits described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
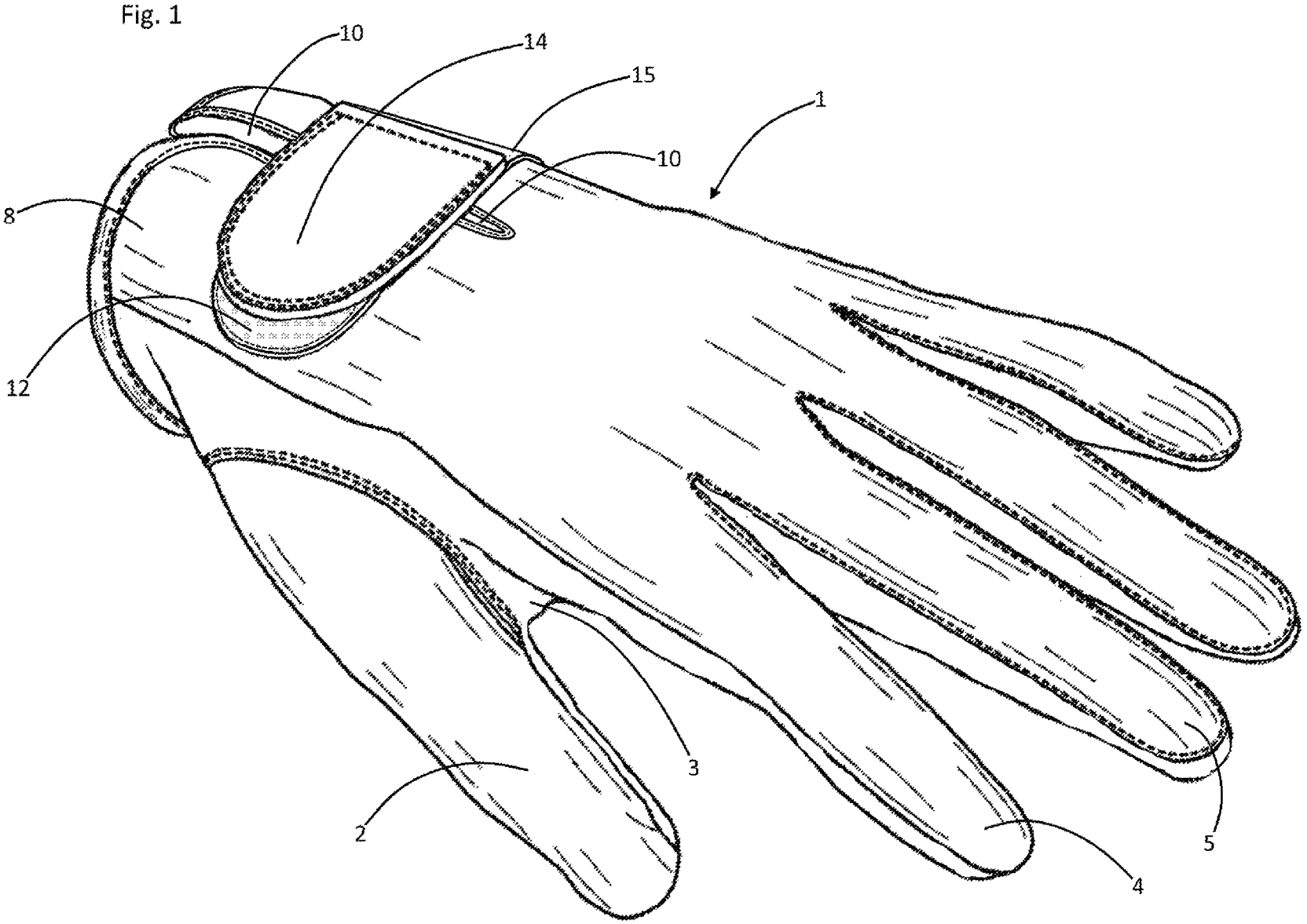
FIG. 1 is a perspective view of an athletic glove upon which the instant inventive cover may be utilized.
Figure 2:
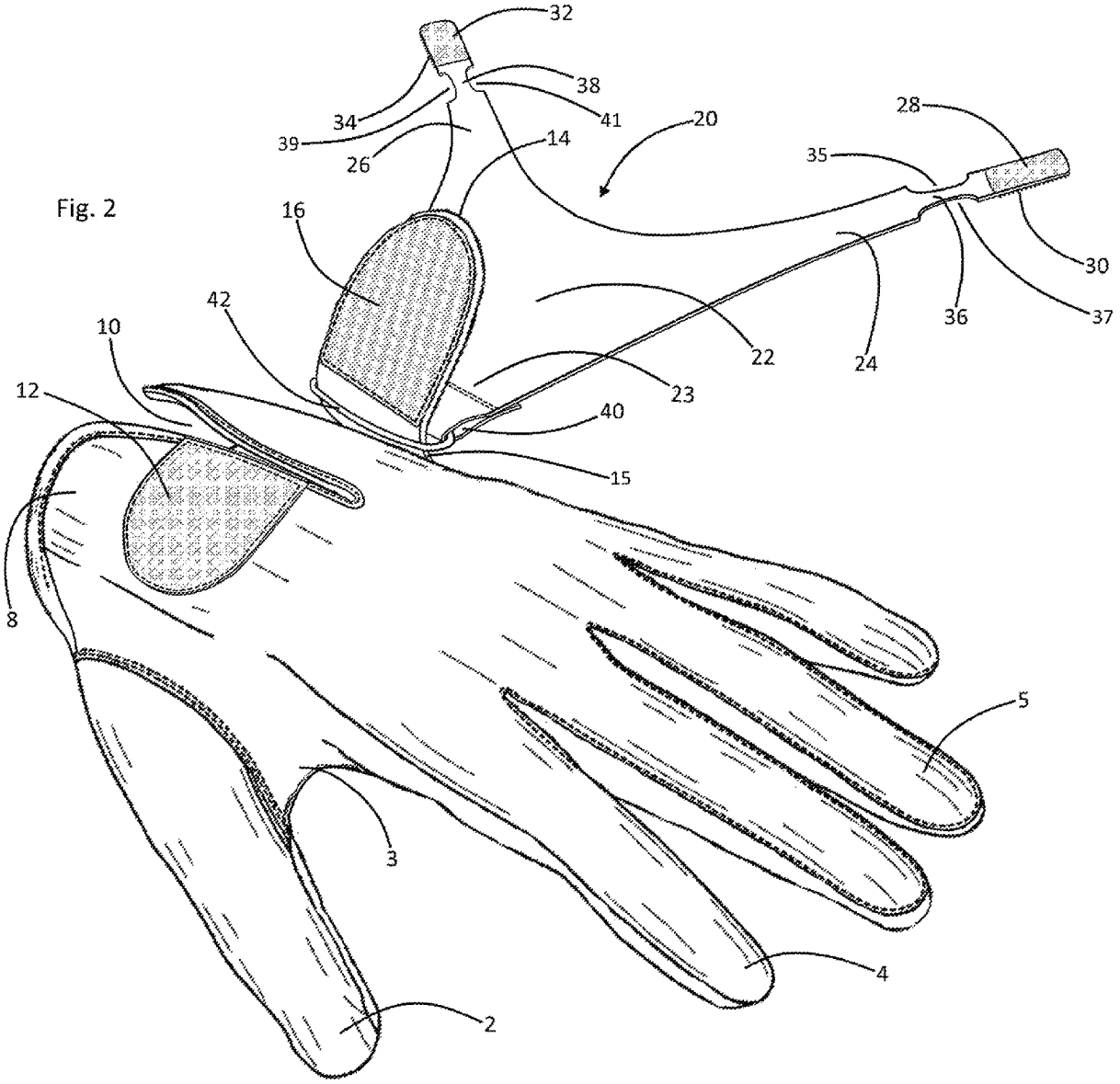
FIG. 2 redepicts the structure of FIG. 1, the view of FIG. 2 showing an initial engagement of the instant inventive glove cover with a disconnected glove wrist strap component.

Referring now to the drawings and in particular to Drawing FIGS. 1 and 2, a sports glove of the type which may be covered and protected by the instant inventive glove cover is referred to generally by Reference Arrow 1. The exemplary glove 1 constitutes a left hand glove which is suitably worn by a right handed golfer whose non-dominant hand is typically the left hand.

The golf glove 1 has a thumb portion 2, an index finger portion 4, and three other fingers 5. The glove 1 has a first web 3 spanning laterally between the base ends of the thumb 2 and the index finger 4, and has similar webs between the glove's other fingers 5.

A wrist sizing slot 10 extends longitudinally across the glove's wrist portion 8, and a wrist sizing strap 14 is commonly provided upon such glove to work in relation with slot 10. The wrist sizing strap 14 may be utilized by a golfer in order to snugly and securely anchor the wrist portion 8 of the glove 1 annularly about the wrist of the golfer's left hand. The base end 15 of the wrist sizing strap 14, in combination with such strap's hook pad fastener 16 constitute strap mounting structures which the instant inventive cover causes to further function as cover mounting structures.

The loop pad 12 and flexible hook pad 16 combination which is positioned for securing the wrist sizing strap 14 at a selected circumferential position over the back of the glove 1, commonly attaches the loop pad 12 stitching to the back of the glove 1, and attaches the flexible hook pad 16 attached by stitching to the interior surface of the circumferentially distal end of the wrist sizing strap 14."

Referring to FIGS. 2-5, a preferred embodiment of the instant inventive cover is referred to generally by Reference Arrow 20, the cover 20 comprising a flexible sheet 27 having a central palm covering portion 22. In the preferred embodiment, the flexible sheet 27 comprises durable vinyl. Vinyl constitutes a preferred material because vinyl typically is a lower friction surface than common glove level. Use of vinyl advantageously restores proper hand/handle friction during a golf swing. Suitably, though less desirable, such sheet 27 may be composed of other durable sheet materials such as a leather or woven fabric.

The flexible sheet 27 preferably has a base end 23 whose longitudinal or front to rear dimension closely matches the front to rear dimension of the base end 15 of the glove's wrist sizing strap 14. A loop component 42 is preferably fixedly attached to the base end 23 of the flexible sheet 27, such loop 42 suitably being captured and secured thereto by a sewn hem 40. The loop 42 preferably is composed of elastic cord. Suitably, the loop 42 may alternatively comprise a longitudinally oblongated rigid or metal or plastic ring which is similarly sized for receipt of wrist sizing strap 14.

Further structural components of the inventive cover comprise web and wrist arms 24 and 26 which are fixedly attached to or formed wholly and continuously with the flexible sheet 27. The web and wrist arm components of the cover 20 necessarily extend oppositely from the cover's base end 23.

In the preferred embodiment, the wrist arm 26 of the cover 20 is angled or canted rearwardly as indicated in FIG. 2 so that such arm 26 may extend circumferentially about wrist 8 while the web arm 24 spans over web 3.

Further structural components of the instant invention comprise flexible hook pads 30 and 34, which may be respectively fixedly attached to the distal ends of the web and wrist arms 24 and 26.

In use of the instant inventive glove cover 20, a golfer may, for example, initially don glove 1 upon his or her left hand. Thereafter, the golfer may extend the distal end of the wrist sizing strap 14 through loop 42, and may slide the loop 42 toward the glove 1 and along the wrist sizing strap 14 until the loop 42 resides at the base end 15 of the wrist sizing strap 14. Such engagement of the loop 42 with the strap base 15, as depicted in FIG. 2, advantageously secures the base end 23 of the cover 20 upon the glove 1.

Assuming that a loop pad 12 is attached to the glove at the site indicated in FIG. 2, and assuming that pads 30 and 34 comprise hook pads, the golfer may wrap the cover 20 in the counter-clockwise direction about the glove 1. As a part of such cover wrapping step, the golfer may cause the cover's web arm 24 to extend over the glove's first web 3 and may cause the glove's wrist arm 26 to extend circumferentially about the glove's wrist 8.

Figure 3:
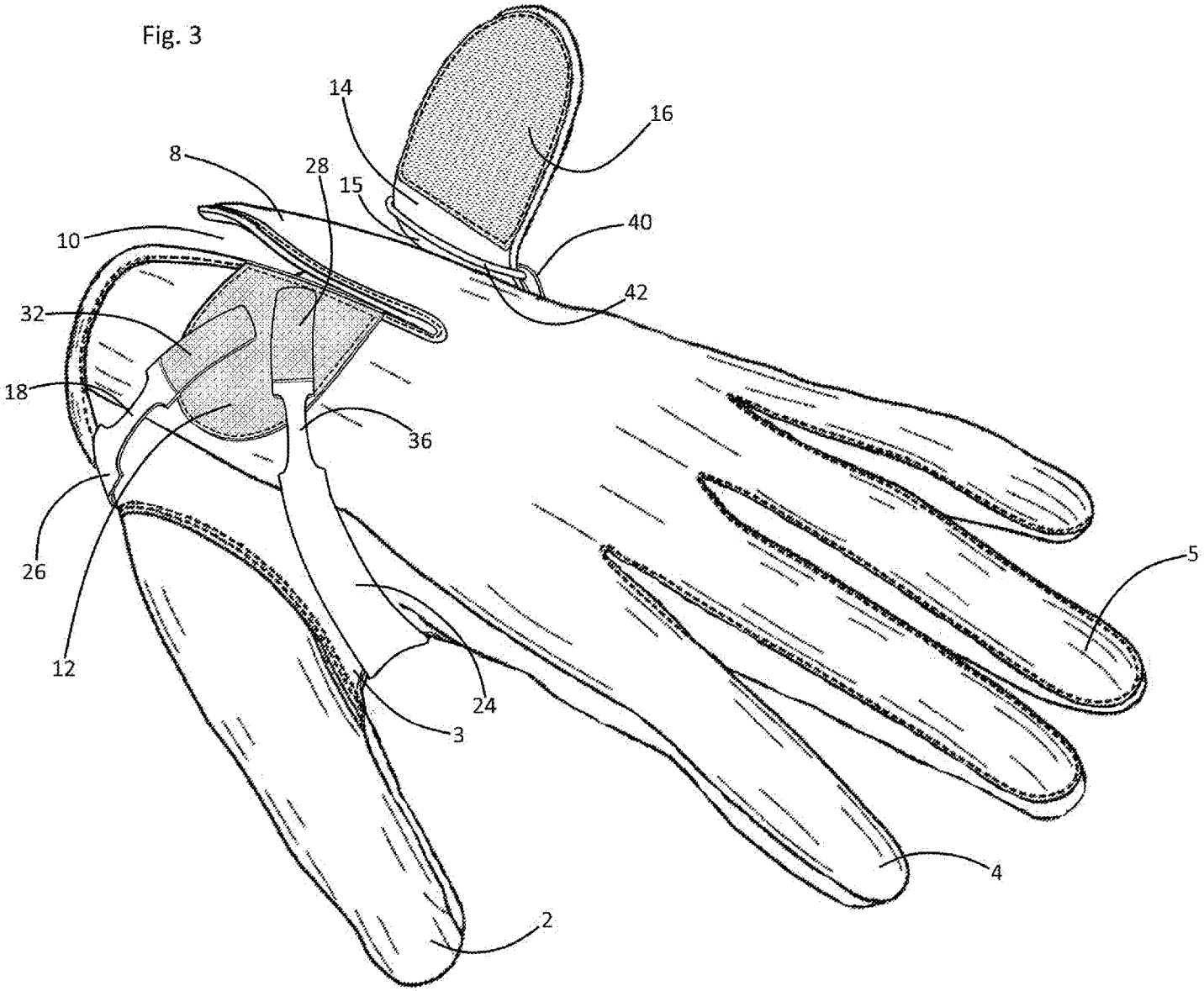
FIG. 3 redepicts the structure of FIG. 2, the view of FIG. 3 showing wrist arm and web arm components of the cover extended about the glove, and showing initial engagements of such arms' distal ends with of the glove's flexible hook and loop fastener.

Thereafter, the flexible hook pads 30 and 34 may be pressed against and engaged with the glove's loop pad 12 in the manner indicated in FIG. 3. Thereafter, the wrist sizing strap 14 may be extended clockwise over the back of the glove, and such strap's flexible hook pad 16 may be similarly pressed against and secured to the glove's loop pad 12 as indicated in FIG. 4.

Figure 4:
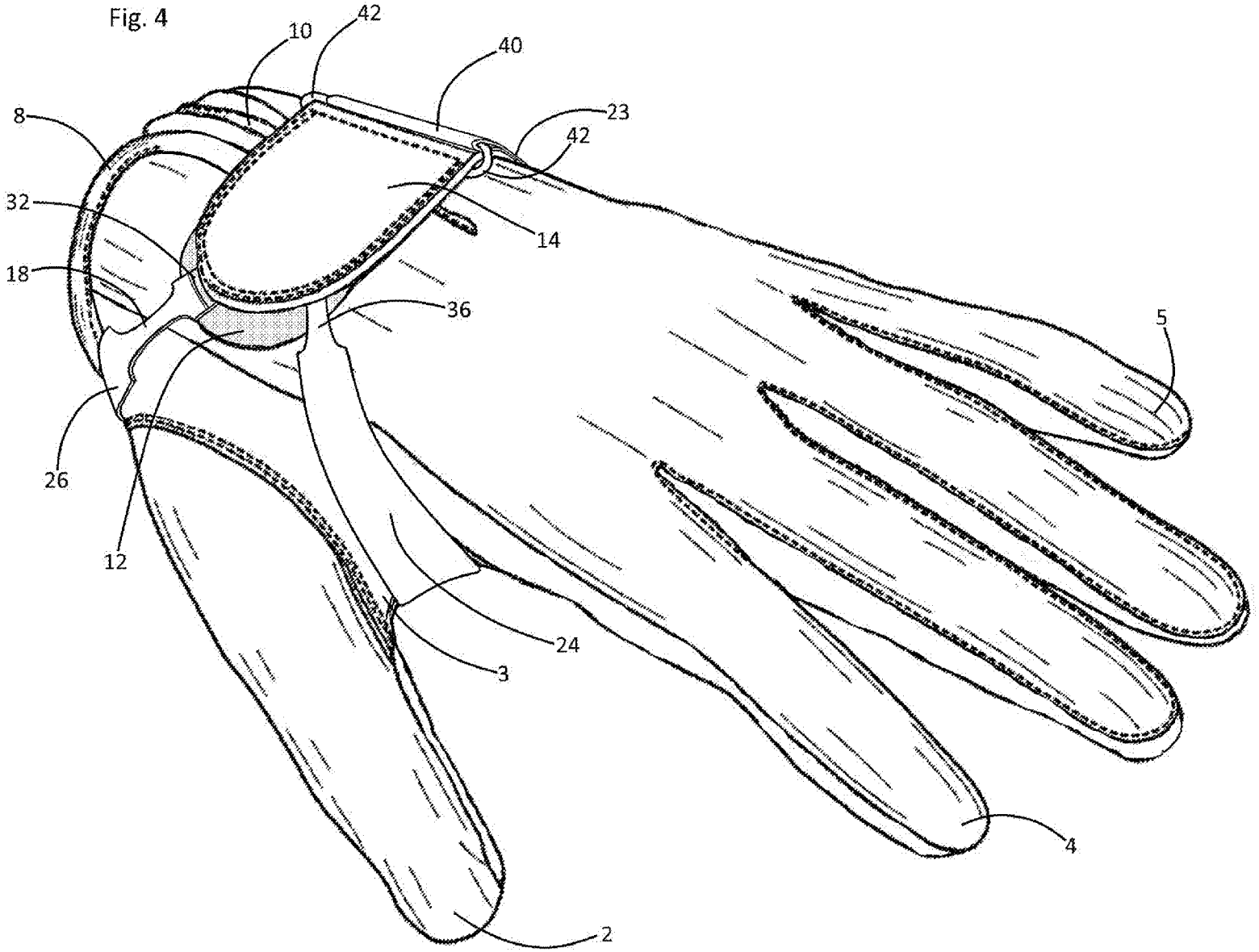
FIG. 4 redepicts the structure of FIG. 3, the view of FIG. 4 showing the glove's wrist strap fastened and showing such strap's engagements with distal ends of arm components of the instant inventive cover.
Figure 5:
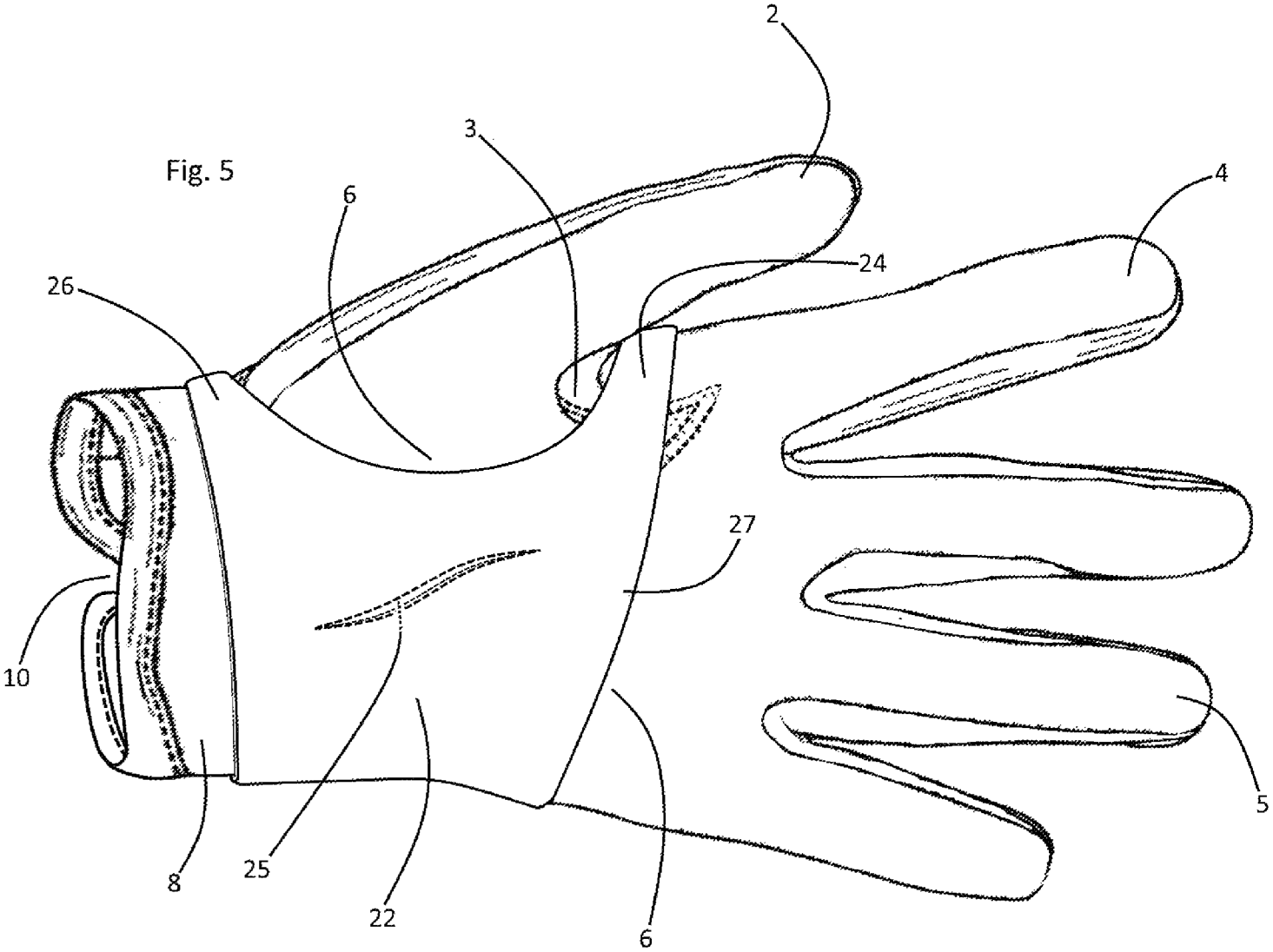
FIG. 5 is a reverse view of the structure of FIG. 4, the view demonstrating the instant invention's glove palm covering function.

In the FIG. 4 configuration, the base end 23 of the cover 20 remains secured to the wrist sizing strap 14 by loop 42 while the distal ends of the web wrist arms 24 and 26 are additionally interstitially secured between the hook pad 16 of wrist sizing strap 14 and the loop pad 12. The invention's three point anchoring of the cover's base end 23, web arm 24, and wrist arm 26 advantageously securely positions the cover's palm covering portion 22 over the palm 6 of the glove 1. Where the glove 1 has, for example, a tear 25 within its palm portion 6, the palm covering portion 22 of the cover 20 advantageously restores and continues the palm protecting and covering function of the glove.

In the preferred embodiment, referring to FIG. 2, the distal ends of the web and wrist arms 24 and 26 include additional fastener pads 28 and 32. Where the pads 30 and 34 comprise flexible hook pads (as depicted in FIG. 2), pads 28 and 32 preferably comprise loop pads. Such loop pads 28 and 32 may advantageously additionally anchor the cover 20 via their outward engagements with the glove's flexible hook pad 16. Accordingly, the invention's pads 30, 34, 28, and 32 interstitially engage the glove's loop pad 12 and flexible hook pad 16 in manners consistent with hook and loop pad fastening.

To accommodate for situations where the glove's flexible hook pad 16 and loop pad 12 are reversed in their orientations (i.e., with the hook pad attached to the back of the glove, and with the loop pad attached to the wrist sizing strap 14), the arm distal ends' pads 30, 34, 28 and 32 may correspondingly have reversed orientations."

Figure 6:
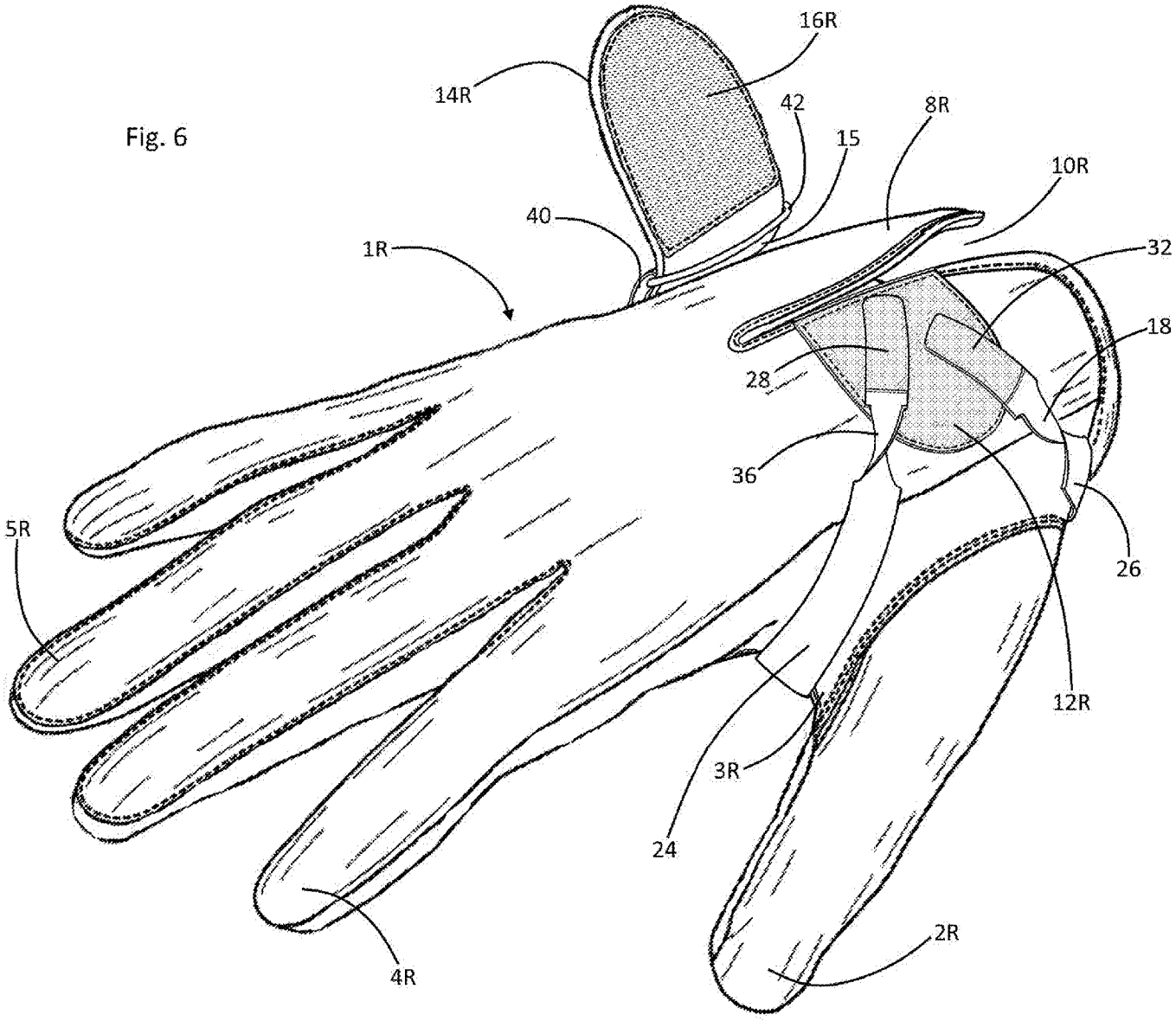
FIG. 6 redepicts the glove cover of FIGS. 2, 3, 4, and 5, the view alternatively showing such glove cover in engagement with a right hand sports glove.

Referring to the alternative right hand worn golf glove of FIG. 6, each structure identified by a reference numeral having the suffix "R" is configured substantially identically with similarly numbered structures appearing in FIGS. 1-5. Where such alternative right hand worn glove 1R is to be protected by the instant inventive glove cover 20, the cover may ambidextrously attach to such glove for use by a golfer having a dominant left hand.

Assuming that the loop pad 12R and hook pad 16R of the 1R glove are oriented consistently with the loop pad 12 and hook pad 16 of the right handed (and left hand worn) glove 1 of FIGS. 1-5, the alternative ambidextrous attachment of the cover 20 to the left handed glove 1R may disadvantageously invert the pads 28, 30, 32, and 34, undesirably causing hook pads to face a hook pad and causing loop pads to face a loop pad within the interstitial pad attachment. Such pad to pad contacts may undesirably result in insufficient anchoring of the web and wrist arms 24 and 26.

To accommodate for and prevent such insecure web and wrist arm attachments, the web and wrist arms 24 and 26 may be advantageously modified to include relatively narrow front and rear twist accommodating sections 36 and 18. Such sections may suitably comprise mirroring "C" shaped voids 35, 37, 39, and 41 formed within arms 24 and 26. As indicated in FIG. 6, such twist sections 36 and 18 advantageously allow the distal ends of arms 24 and 26 to be conveniently twisted and inverted 180° to achieve proper orientations of the glove's, pads 30, 34, 28, and 32 with respect to the glove's loop pad half 12R and hook pad 16R.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. A glove covering assembly comprising:

(a) a glove having a back, a wrist, a thumb, a forwardly extending index finger, a first web between the thumb and the forwardly extending index finger, and a wrist sizing strap;

(b) a wrist sizing strap fastener comprising a wrist sizing strap hook pad and wrist sizing strap loop pad adapted for securing an end of the wrist sizing strap upon the glove's back;

(c) a flexible sheet having a palm covering portion, the palm covering portion having a base end;

(d) a loop fixedly attached to the palm covering portion's base end, wherein the wrist sizing strap extends through the loop;

(e) a web arm comprising a portion of the flexible sheet, the web arm having a distal end, the web arm extending from and being attached to the palm covering portion;

(f) a wrist arm comprising another portion of the flexible sheet, the wrist arm having a distal end, the wrist arm extending from and being attached to the palm covering portion;

(g) a first web arm fastener fixedly attached to the web arm's distal end, wherein the first web arm fastener comprises a pad selected from the group consisting of hook pads and loop pads, wherein said selected pad is captured between the wrist sizing strap hook pad and the wrist sizing strap loop pad; and (h) a first wrist arm fastener fixedly attached to the wrist arm's distal end, wherein the first wrist arm fastener comprises another pad selected from said group consisting of hook pads and loop pads, wherein said another pad is captured between the wrist sizing strap hook pad and the wrist sizing strap loop pad.

2. The glove covering assembly of claim 1 further comprising front and rear twist sections respectively fixedly attached to or formed wholly with the web arm and the wrist arm.

3. The glove covering assembly of claim 2 wherein the fixed attachment of the loop to the palm covering portion's' base end comprises a hem.

4. The glove covering assembly of claim 3 wherein the loop comprises a flexible cord.

5. The glove covering assembly of claim 1 wherein the flexible sheet is composed of vinyl.

6. The glove covering assembly of claim 1 wherein each of the web arm distal end and the wrist arm distal end has a pair of sides, a second web arm fastener is attached to one of the pair of sides of the web arm distal end, a second wrist arm fastener is attached to one of the pair of sides of the wrist arm distal end, and each of the second web arm fastener and second wrist arm fastener comprises a pad selected from said group consisting of hook pads and loop pads.

* * * * *